US005469412A

United States Patent [19]

Weise

[11] Patent Number: 5,469,412

[45] Date of Patent: Nov. 21, 1995

[54] ANALOG WATCH, MORE SPECIFICALLY A WRIST WATCH

[75] Inventor: Edgar H. Weise, Stettfurt, Switzerland

[73] Assignee: Yperwatch S.A., Vaumarcus, Switzerland

[21] Appl. No.: 297,557

[22] Filed: Aug. 26, 1994

[30] Foreign Application Priority Data

Sep. 9, 1993 [CH] Switzerland ..... 02675/93

[51] Int. Cl.[6] ..... G04B 37/00

[52] U.S. Cl. ..... 368/88; 368/11; 368/10; 368/281

[58] Field of Search ..... 368/10, 88, 281, 368/282, 276–280

[56] References Cited

U.S. PATENT DOCUMENTS 3,968,640 7/1976 Clemmer et al. ..... 368/69
4,733,383 3/1988 Waterbury .
5,091,771 2/1992 Bolan et al. ..... 368/87

FOREIGN PATENT DOCUMENTS 52-29776 3/1977 Japan .
56-31684 3/1981 Japan .

*Primary Examiner*—Bernard Roskoski
*Attorney, Agent, or Firm*—Spencer, Frank & Schneider

[57] ABSTRACT

The analog watch, more specifically the wrist watch, having watch and dial means as well as motor-driven actuating means and battery in one housing also comprises additional means for measuring and indicating, especially of nuclear radiation, disposed in the watch housing, which means include a circuitry carrier with a printed circuit that is folded into the housing, flexible, and planar in its development, which circuitry carrier connects a measuring sensor with the indicator means via an amplifier and evaluator circuit.

10 Claims, 2 Drawing Sheets

ANALOG WATCH, MORE SPECIFICALLY A WRIST WATCH

BACKGROUND OF THE INVENTION

The present invention relates to an analog watch, more specifically to a wrist watch, having watch and dial means as well as motor-driven actuating means and battery in one housing.

In U.S. Pat. No. 4,608,655, it has already been proposed to provide a digital watch with a dosimeter circuit arrangement so as to make it possible for everybody to obtain concrete data on the current radiation exposure in one's environment in a handy manner.

However, the development of such digital watches came to a standstill because it was not possible to accommodate the extensive circuitry means for measuring and indicating, especially a nuclear radiation, in the housing of the digital watch, even though LCD displays used to indicate data already form integrated components of such watches.

Moreover, since digital watches are no longer very popular on the market and analog watches have regained significantly in impedance, it is now the object of the present invention to provide an analog watch, more specifically a wrist watch, which aside from its usual timer functions is capable of exactly measuring and indicating existing nuclear radiation.

SUMMARY OF THE INVENTION

According to the invention, this will first of all be achieved by additional .means for measuring and indicating, especially a nuclear radiation, disposed in the watch housing, which means include a circuitry carrier with a printed circuit that is folded into the housing, flexible, and planar in its development, which circuitry carrier connects a measuring sensor with the indicator means via an amplifier and evaluator circuit.

By appropriately folding in a circuit carrier, which according to the invention is flexible, it has now become possible to accommodate not only watch caliper and watch battery but also the extensive circuitry means, including measuring sensor as well as amplifier and evaluator circuit of a dosimeter in the watch housing.

Preferably, another embodiment of the analog watch according to the invention consists in that the folded-in flexible circuitry carrier encompasses a first intermediate plate carrying the watch work by bending of planar pads which project in the development of the circuitry carrier and that with another planar part it reaches under a second intermediate plate carrying the primary battery for the watch drive. Here, it is convenient if the circuitry means of the circuitry carrier connect the primary battery and a secondary battery used for saving of data with at least the amplifier and evaluator circuit.

Furthermore, a compact design will be obtained in that one of the intermediate plates includes a projection for support of the measuring sensor which is surrounded by an extension of the watch housing.

It is also essential for the invention that the means for indicating radiation be LCD displays, or that the means for indicating radiation include an additional dial train.

It is also important that the secondary battery for saving of data is connected via the amplifier and evaluator circuit and cooperates with a detector so as to detect and indicate a voltage drop at the primary battery of the watch, and to perform an automatic switchover from the primary battery to the secondary battery.

Furthermore, a connection between the motor of the watch work and the dosimeter time base of the multiprocessor is also essential for the invention in order to ensure exact time measurands.

BRIEF DESCRIPTION OF THE DRAWING

Exemplary embodiments of the subject matter of this invention will be explained in further detail hereinafter with reference made to the drawing wherein.

DETAILED DESCRIPTION OF THE PREFERRED EMBODIMENTS

Figure 1:
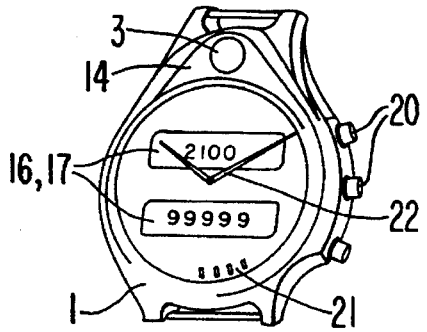
FIG. 1 is a diagrammatic representation of an analog wrist watch having a measuring sensor integrated in the housing for measuring, and LCD displays for indicating, detected nuclear radiation.

FIG. 1 shows first of all a model of an analog wrist watch according to the invention having a measuring sensor 3 integrated in the housing 1 and LCD displays 16, 17 for measuring and indicating nuclear radiation. Furthermore, the conventional features of an analog watch, that is dial plate 21 and dials 22, are designed visibly and in the usual manner.

Figure 2:
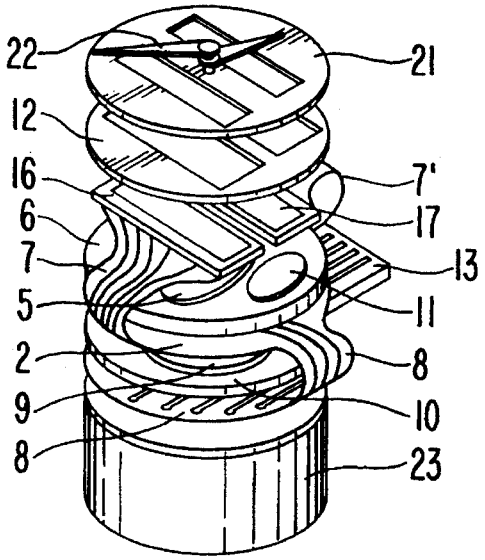
FIG. 2 is an exploded view of the most essential parts of the analog switch of FIG. 1.

In accordance with the view shown in FIG. 2, the problem of accommodating the circuitry means for a dosimeter for measuring and indicating alpha, beta, or gamma rays is solved in that the printed conductors and circuitry means are disposed on a circuitry carrier 2 that is folded into the housing of the watch (not shown), flexible and planar in its development.

Figure 4:
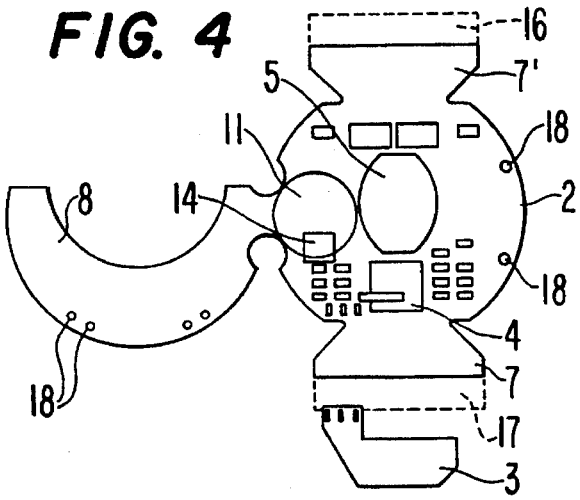
FIG. 4 is a developed view of the circuitry carrier used in FIG. 2 including a printed circuit and circuitry means.

Such a circuitry carrier 2 can be made of polyimide lined with metal on both sides and containing photomechanically formed structures and printed conductors, and appropriate plated-through holes 18 (FIG. 4).

In FIG. 2 a first embodiment consists in that the folded-in, flexible circuitry carrier 2 encompasses a first intermediate plate 6 carrying the watch work 5, which is accomplished by bending planar parts 7, 7' which project in the development of the circuitry carrier 2, and that with another planar part 8 it reaches under a second intermediate plate 10 carrying the primary battery 9 for the watch drive.

Further intermediate plates 12 and an intermediate housing 23, preferably made of plastic material, to accommodate all elements prior to their integration into the watch housing 1 can be provided.

Preferably, the intermediate plate 10 includes a projection 13 serving as support of the measuring sensor 3 which is surrounded by an extension 14 of the watch housing 3 (FIG. 1).

In this case, the circuitry means of the circuitry carrier 2 connect the primary battery 9 and another secondary battery 11 used for saving data with at least the amplifier and evaluator circuit 4 as will be explained hereinafter in further detail with reference to the block diagram of FIG. 3.

Figure 5:
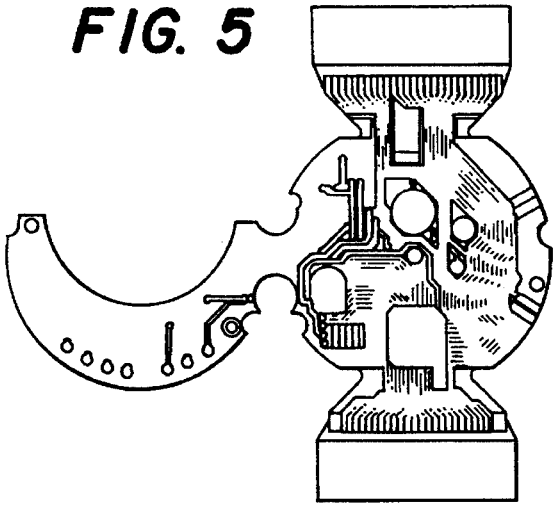
FIGS. 5 and 6 are photographic views of one and the other side of the circuitry carrier of FIG. 4.
Figure 6:
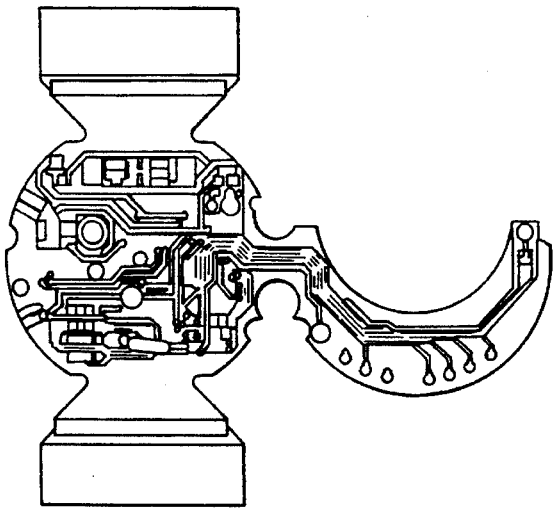

FIG. 4 is a diagrammatic view of the development of the above circuitry carrier 2, whereas FIGS. 5 and 6 are photographic views of one and the other side of the circuitry carrier 2 to illustrate the arrangement of the printed conductors and the circuit elements.

Dosimeter circuits are per se known. In accordance with the block diagram shown in FIG. 3, a FET impedance converter, for example, at whose gate the anode of the measuring sensor 3 and a load resistor 15 (FIG. 7) are applied, serves as charge-sensitive amplifier 14' for the measuring sensor 3 which may be a PIN photodiode having a size of approximately 3 $mm^2$ of detector area. The gamma rays or the like impinging on the silicon of the sensor 3 produce charge transfers changing the electrical potential applied at the resistor such that a voltage will be created at the gate which changes the zero signal current adjusted by means of further resistors (not shown) and generates electrical pulses. These pulses will then pass through the amplifier and evaluator circuit 4 to be displayed on the LCD displays 16 and 17.

According to the invention, in another embodiment that is not shown in detail, said electrical pulses may act on another dial train as a measure of received radiation so as to display the radiation dose also in an analog mode.

As has already been pointed out, an essential feature of this invention consists in providing a secondary battery 11 for saving of data, which is connected through the amplifier and evaluator circuit 4 and cooperates with a detector that is not shown in detail so as to detect and indicate a voltage drop at the primary battery 9 of the watch, or to perform automatic switchover from the primary battery 9 to the secondary battery 11.

Figure 3:
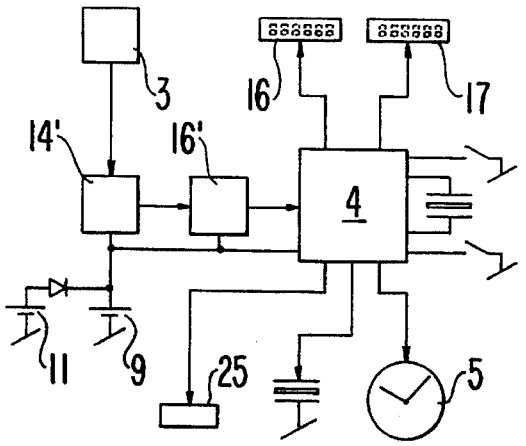
FIG. 3 is a block diagram of the measuring sensor arrangement with integrated amplifier and evaluator circuit and watch drive of the watch of FIG. 1.

Furthermore, FIG. 3 shows that another essential feature of this invention consists in the connection between the motor of the watch work 5 and the dosimeter time base of the multiprocessor 4 in order to ensure exact time measurands.

All functions of the analog watch according to the invention can be set by means of conventional crown-shaped setting means 20 (FIG. 1).

Figure 7:
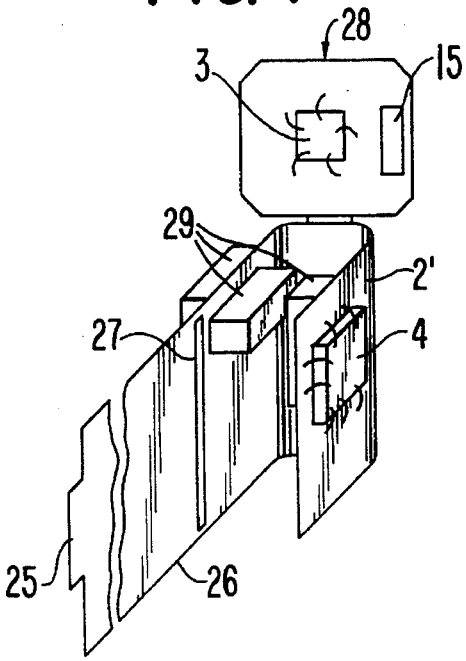
FIG. 7 is an embodiment variant of a circuitry carrier in a partially developed view.

The embodiment illustrated in FIG. 7 illustrates a circuitry carrier 2' that can be folded-in in a different manner, is flexible, and planar in its development, which circuitry carrier can be joined annularly around the axis a—a and fixed with a push-in strap 25. In this case, an isolating point 27 can be provided in part 26 of the development so as to limit a shielding 26. Here, a projecting planar part 28 which can be bent away carries the measuring sensor 3, whereas the annular body, on both sides, carries circuit elements 29 and the multiprocessor 4, respectively.

This measure makes it possible for the first time to equip an analog watch, especially a wrist watch of conventional design, with a dosimeter disposed inside the watch housing.

By way of the linking element 25 (FIG. 3), the arrangement according to the invention can be connected to a computer testing and evaluating unit.

While there are shown and described preferred embodiments of the invention, it is to be distinctly understood that the invention is not limited thereto but may be embodied and practised within the scope of the following claims.

What I claim is:

1. An analog watch comprising (a) a watch housing;

(b) a nuclear radiation sensing unit supported in said watch housing and including
  (1) a sensor element; and
  (2) a display device;

(c) a flexible carrier received in said watch housing; said flexible carrier having a first and a second flat part connected to said flexible carrier and folded thereover onto opposite faces of said flexible carrier;

(d) an amplifier and evaluator circuit accommodated in said watch housing;

(e) a first intermediate plate disposed between said carrier and said first flat part;

(f) a second intermediate plate disposed between said carrier and said second flat part;

(g) a watch work mounted on said first intermediate plate;

(h) a battery mounted on said second intermediate plate; and (i) conductor means printed on said carrier for connecting said battery and said sensor with said amplifier and evaluator circuit and for connecting said amplifier and evaluator circuit with said watch work and said display device.

2. The analog watch as defined in claim 1, wherein said battery is a primary battery; further comprising a data-saving secondary battery mounted on said second intermediate plate; said secondary battery being connected to said amplifier and evaluator circuit by said conductor means.

3. The analog watch as defined in claim 2, further comprising detector means for detecting and indicating a voltage drop across said primary battery and for performing an automatic switchover from said primary battery to said secondary battery.

4. The analog watch as defined in claim 1, further comprising a projection extending from one of said first and second intermediate plates; said sensor element being supported by said projection.

5. The analog watch as defined in claim 4, wherein said watch housing has an enlargement accommodating said projection.

6. The analog watch as defined in claim 1, wherein in a developed state said first and second flat parts project from said carrier and lie coplanar therewith.

7. The analog watch as defined in claim 1, further comprising means for connecting said nuclear radiation sensing unit to an external testing and evaluating device.

8. The analog watch as defined in claim 1, wherein said display device is an LCD device.

9. The analog watch as defined in claim 1, wherein said display device includes a dial.

10. The analog watch as defined in claim 1, wherein said watch work includes a motor and said amplifier and evaluator circuit includes a dosimeter time base connected to said motor to ensure exact time measuring values.

* * * * *